US005755413A

United States Patent [19]

Press

[11] Patent Number: 5,755,413

[45] Date of Patent: May 26, 1998

[54] APPARATUS AND METHOD FOR ARRANGING NAPKINS

[76] Inventor: Ann Press, 777 N. Michigan Ave., Chicago, Ill. 60611

[21] Appl. No.: 812,123

[22] Filed: Mar. 5, 1997

[51] Int. Cl.[6] ..... A47J 47/16

[52] U.S. Cl. ..... 248/175; 24/7; 24/9; 24/570; D7/631; D7/633

[58] Field of Search ..... 248/175; 24/7, 24/9, 329, 570; D7/631, 633

[56] References Cited

U.S. PATENT DOCUMENTS

D. 309,556 7/1990 Bergson .
483,331 10/1892 Spaulding .
2,235,986 3/1941 Ellingson ..... 248/175
4,420,102 12/1983 Clark .
4,494,718 1/1985 Clay .

*Primary Examiner*—Leslie A. Braun
*Assistant Examiner*—Donald J. Wallace
*Attorney, Agent, or Firm*—Don Moyer

[57] ABSTRACT

Napkins can be arranged into many decorative forms using a frame which bounds a right circular cylinder. Napkins can be folded, inserted into the frame and arranged through and around the first base of the cylinder, through and around the second base of the cylinder, and through the cylinder lateral surface. Napkins can have color regions which present one pattern when fully flat open and which are transmogrified into a new form, such as a flower-like form, when arranged using the frame.

6 Claims, 2 Drawing Sheets

APPARATUS AND METHOD FOR ARRANGING NAPKINS

FEDERAL SPONSOR

NOT APPLICABLE

RELATED APPLICATIONS

NOT APPLICABLE

MICROFICHE APPENDIX

NOT APPLICABLE

BACKGROUND

This apparatus and method for arranging napkins uses a frame through and around which a folded napkin can be arranged. The apparatus and method also uses a napkin with color regions which present one appearance when open, and when folded in a conventional manner, and which are transmogrified to a new form when arranged using the frame.

Various special purpose napkin rings are shown in prior art. In U.S. Pat. No. 483,331 Spaulding shows a napkin ring which has two portions made of several turns of wire and has barbed wire arms projecting beyond the ring which are used to attach a napkin to the clothing of the user. The two portions of the ring are connected by the wire and also connected by a nameplate which is attached between the two portions. This ring can have only the most limited use for arranging napkins because the projecting arms do not allow the ring to be used to stably support an arranged napkin with the long axis of the ring vertical, because there are two connections between the two portions thus impeding arrangement of a napkin between the two portions, because the dimensions of the two portions along the long axis of the ring limit arrangement of a napkin through and around either of the two portions, and because the projecting arms impede arrangement of a napkin through and around either of the two portions.

In U.S. Pat. No. 4,420,102 Clark shows a napkin ring with elements inside the ring which channel a napkin into a decorative shape. This ring eases the achievement of the decorative shape, but it can not be used more generally for arranging napkins. A folded napkin can not, in general, be inserted into this ring, and the ring has only two open ends through which a napkin can be arranged. In U.S. Pat. No. 4,494,718 Clay shows a block with a first shaft through the block and a second shaft connecting the first shaft to the block surface so that a napkin can be arranged through both ends of the first shaft and through the outside end of the second shaft. The dimensions and massive structure of this holder severely limit its use for arranging napkins. In U.S. Pat. Des. No. 309,556 Bergeson shows a napkin arranger in the form of a helical band. Again the dimensions and structure of this arranger severely limit its use for arranging napkins.

Thus there is an opportunity to devise an apparatus and method which will support a very wide range of napkin arrangements and which will support a new form of arrangement.

SUMMARY

Objects of this invention comprise the following. Make a frame which bounds a right circular cylinder and which can be used to arrange napkins into many decorative forms.

Make a frame which can be used in a napkin arranging method, the method comprising: folding a napkin, inserting the napkin into the frame, and arranging the napkin through and around a first base of the cylinder, through and around a second base of the cylinder, and through and around the cylinder lateral surface. Make a napkin having color regions which present one appearance when flat open, and when folded in conventional ways, and which are transmogrified to a new form when arranged using the frame.

In summary, one embodiment of this invention is a frame which bounds a right circular cylinder and a napkin which can be folded, inserted in the frame, and arranged through and around a first base of the cylinder, through and around a second base of the cylinder, and through and around the lateral surface of the cylinder into many decorative forms including decorative forms which transmogrify color regions of the napkin.

Other equivalent embodiments will be comprehended in the drawings and detailed description, which will make additional equivalent embodiments obvious hereafter to persons skilled in the art.

DRAWINGS

DETAILED DESCRIPTION

Figure 1:
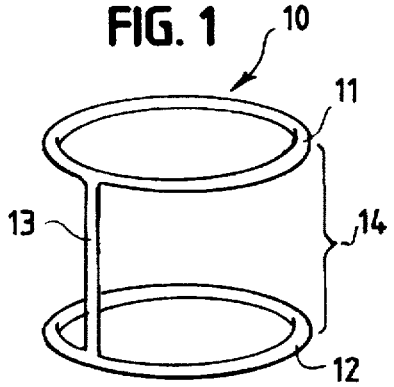
FIG. 1 shows the new frame which is used to arrange napkins.

A frame 10 which can be used for arranging napkins is shown in FIG. 1. The frame has a first hoop 11, has a second hoop 12, and has a connector 13 connecting the first hoop and the second hoop. The first hoop is generally circular and bounds a first base of a generally right circular cylinder. The second hoop is generally circular and bounds a second base of the cylinder. The cylinder has a lateral surface 14 which is fully open except for a minority of the lateral surface which is bounded by the connector.

Figure 2:
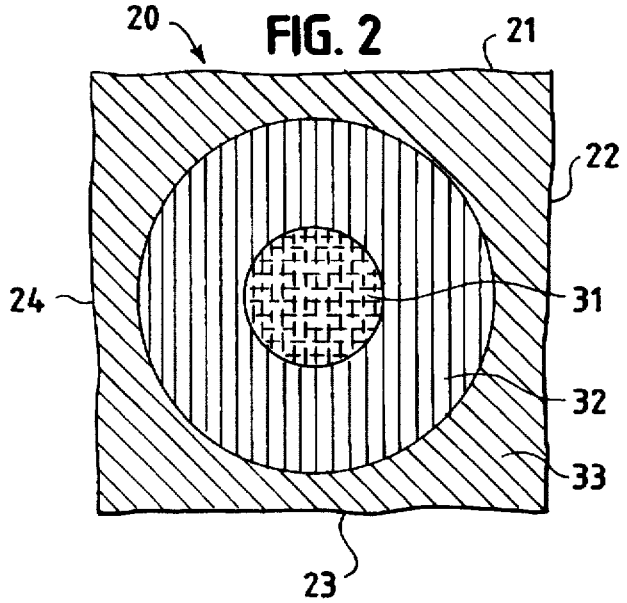
FIG. 2 shows a table napkin with three color regions to use with the frame.

A generally rectangular fully flat open napkin 20 is shown in FIG. 2. The napkin has a first edge 21, a second edge 22, a third edge 23, and a fourth edge 24. The napkin has a first color region 31, a second color region 32, and a third color region 33 all ordered into a pattern of concentric circles. With this napkin fully flat open, the second hoop of the frame is placed on the napkin in the center of the napkin, and the napkin is inserted into the frame, center first, automatically folding the napkin.

Figure 3:
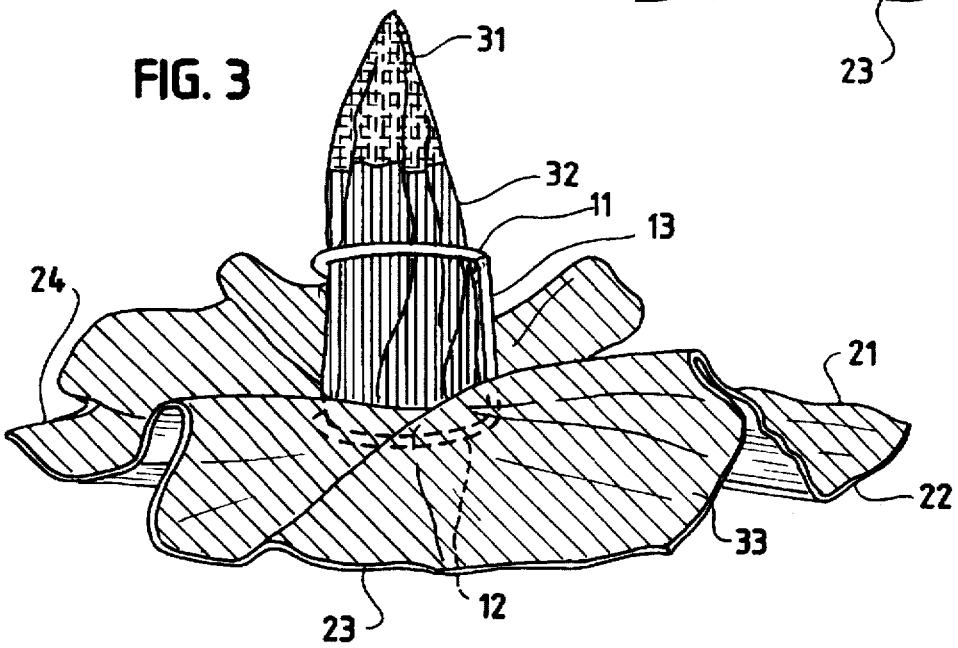
FIG. 3 shows the napkin folded and inserted in the frame.

FIG. 3 shows the napkin folded and inserted in the frame. Here there is partial arrangement of the first edge 21, the second edge 22, the third edge 23, the fourth edge 24, and the third color region 33 through the second hoop. The first color region 31 and the second color region 33, are still folded.

Figure 4:
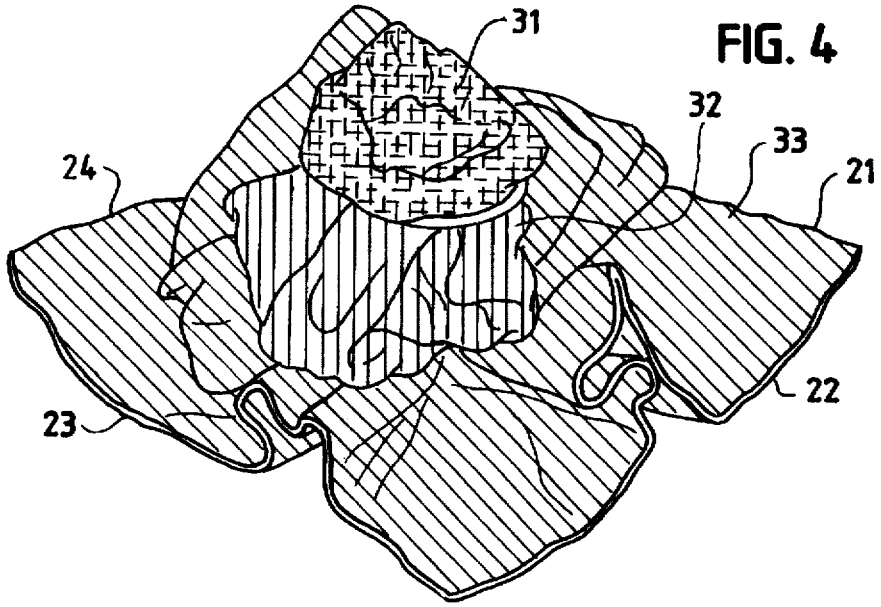
FIG. 4 shows the napkin arranged around the frame.

The napkin arranged is shown in FIG. 4 with the color regions arranged to form a new form which is a flower-like form. The first color region 31, arranged through and around the first hoop 11, the second color region 32, arranged through the cylinder lateral surface 14, and the third color region 33, arranged through the second hoop 12, are altogether transmogrified to the new flower-like form.

Various napkin arrangements, such as this flower-like form, are possible. They depend on being able to unimpededly arrange the napkin through and around the first hoop, to unimpededly arrange the napkin through and around the second hoop, and arrange the napkin through the cylinder lateral surface impeded only by the connector. Also, because of the frame, arrangements, such as this flower-like arrangement, are stable, and can be stably supported on a horizontal surface with the cylinder lateral axis generally perpendicular to the surface.

Figure 5:
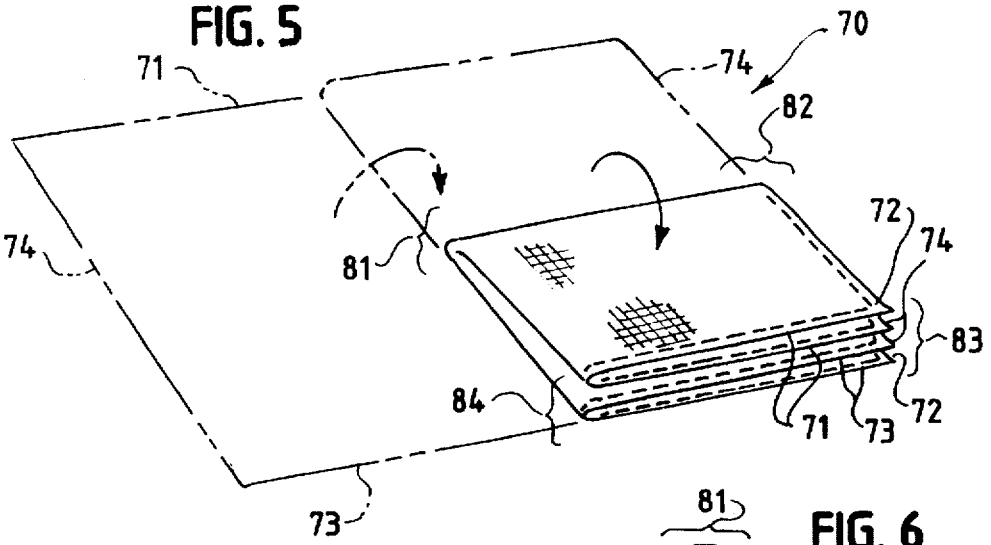
FIG. 5 shows a folding of a second napkin.
Figure 6:
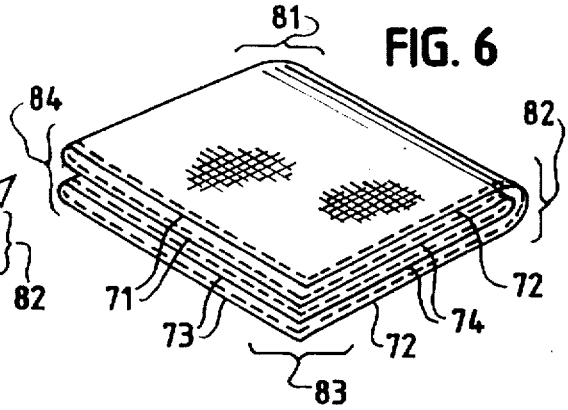
FIG. 6 shows the second napkin folded.
Figure 7:
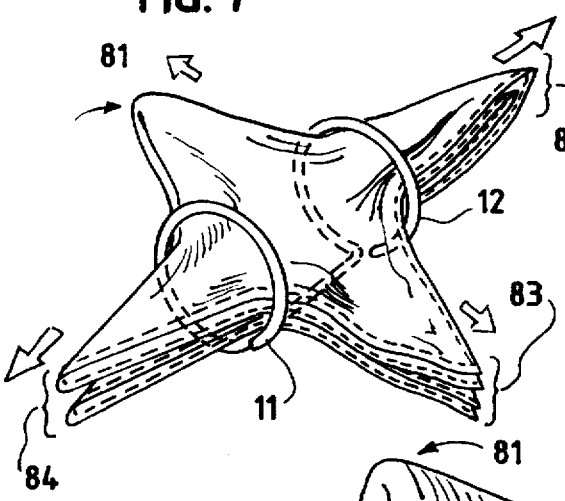
FIG. 7 shows the second napkin inserted into the frame.

A process of folding a second generally rectangular napkin 70 is shown in FIG. 5. The second napkin has a first edge 71, a second edge 72, a third edge 73, and a fourth edge 74. When folded, as shown also in FIG. 6, the second napkin has a first fold corner 81, a second fold corner 82, a third fold corner 83, and a fourth fold corner 84. In FIG. 7 this napkin is shown with the fourth fold corner 84 inserted through the first hoop 11 of the frame and with the second fold corner 82 inserted through the second hoop 12 of the frame. The first fold corner 81 and the third fold corner 83 are positioned through the cylinder lateral surface bounded by the hoops.

Figure 8:
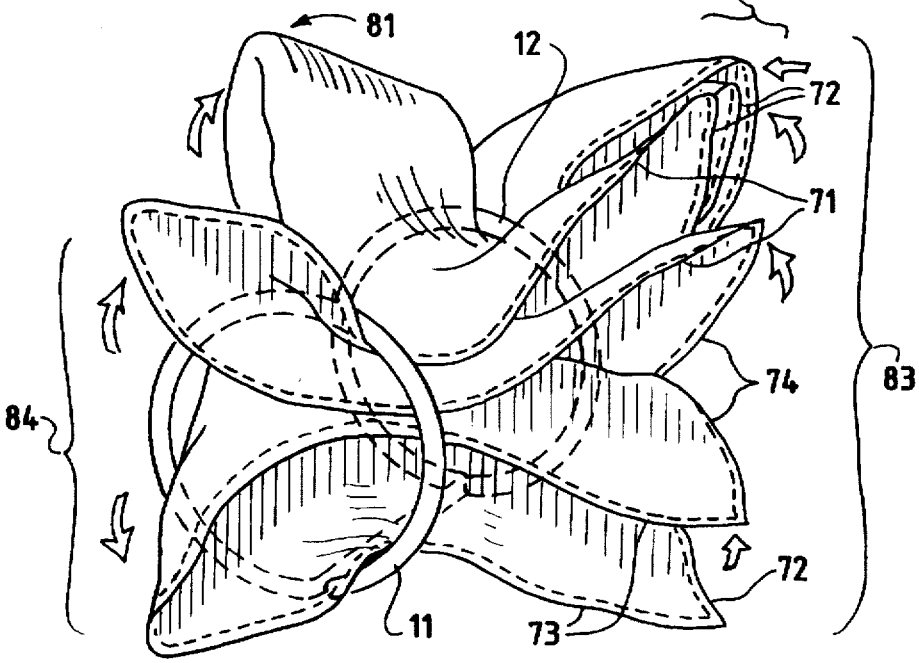
FIG. 8 shows the second napkin arranged in the frame.

In FIG. 8 the napkin is partially arranged through and around the first hoop 11, through and around the second hoop 12, and through the lateral surface. Arrows indicate how the arrangement continues with the napkin edges making up the third folded corner 83 being further opened, with the edges making up the second folded corner 82 being further opened out, and with the edges making up the fourth folded corner 84 being further opened out. When the napkin 70 has different colors on its two flat sides this arrangement is especially effective.

The arrangement shown in FIG. 8, like the arrangement shown in FIG. 4, is possible because the frame supports the napkin when the napkin is arranged unimpededly through and around the hoops and through the lateral surface bounded by the hoops impeded only by the connector. Also the arrangement shown in FIG. 8 is possible because the frame supports the arranged napkin stably on a horizontal surface with the cylinder lateral surface parallel to the surface.

The cross-section diameter of the material of the hoops and connector need only be large enough so that the shape of the frame is stable when the frame is used for arranging napkins. One eight inch diameter metal wire is more than sufficient. This allows the napkin to be easily arranged unimpededly through and around the first hoop and the second hoop and arranged through the cylinder lateral surface impeded only by the connector. Because of this, the napkin can be folded many ways and can be inserted into the frame many ways. Thus, many arrangements of the napkin are enabled. Because of the frame, the arrangements are easy to produce and are stable. Arrangements can be stably supported on a horizontal surface, such as a dinner table, with the cylinder lateral axis generally parallel to the surface and with the cylinder lateral axis generally perpendicular to the surface. The frame could have some flexibility and still provide these functions.

For use with a typical table napkin, which is about twenty inches square, the cylinder bases bounded by the first hoop and the second hoop each have a diameter of about two inches, and the height of the cylinder lateral surface is about two inches. With these dimensions the minority of the lateral surface bounded by a one eighth inch diameter connector is about one fiftieth of the lateral surface. The frame will still be useful for this napkin with variations in these dimensions of about twenty-five percent. For larger and for smaller napkins the dimensions of the frame are scaled to the napkin size and fabric thickness. Napkins which are table cloths, which are a typical table cloth size and larger, can be arranged equivalently using the frame when the frame is scaled in size Arrangements can be made with solid color napkins and with napkins having any pattern of colors. Napkins can have various configurations of color regions which form one pattern when open, and when folded in conventional shapes, and which can be transmogrified to a new form when arranged using the frame Napkins can have various shapes other than the conventional generally rectangular shape and can still be arranged equivalently using the frame and this arranging method. This arranging frame and arranging method can be used with napkins of various sizes, shapes and color patterns. The only necessary property is that the napkin be foldable.

The frame can have other equivalent forms. The hoops could be polygons, could be ellipsoidal, and need not be symmetrical. The hoops need not be closed. The cylinder bounded by the hoops can be oblique. The frame need only support a napkin which has been folded, inserted in the frame, and arranged unimpededly through and around the hoops and through the lateral surface impeded only by the connector Other equivalent forms for the frame, other equivalent forms for napkins, other equivalent transmogrifiable color patterns, other equivalent foldings and inserting, and other equivalent arrangings will be obvious hereafter to persons skilled in the art. It is understood therefore that this invention is not limited to the particular examples shown and described here.

I claim:

1. A napkin arranging set comprising:

a napkin, the napkin being foldable; and a frame, the frame having a first hoop, the frame having a second hoop, and the frame having a connector connecting the first hoop to the second hoop, the first hoop being generally circular and bounding a first base of a generally right circular cylinder, the second hoop being generally circular and bounding a second base of the cylinder, the cylinder having a lateral surface which is fully open except for a minority of the lateral surface which is bounded by the connector, the cylinder having a diameter and the connector having a length both determined so that the frame provides support for the napkin, the napkin being arranged unimpededly through and around the first hoop, through and around the second hoop, and through the cylinder lateral surface impeded only by the connector, the frame may rest stably on a horizontal surface with the cylinder lateral surface generally parallel to the horizontal surface, and alternatively so that the frame may rest stably on the horizontal surface with the cylinder lateral surface generally perpendicular to the horizontal surface.

2. The napkin arranging set of claim 1 wherein the napkin has color regions, the color regions having a first pattern when fully flat open, and the color regions being transmogrified to a new form when the napkin is arranged through the frame.

3. A napkin arranging method comprising the steps:

providing a napkin, the napkin being foldable;

providing a frame, the frame having a first hoop, the frame having a second hoop, and the frame having a connector connecting the first hoop to the second hoop, the first hoop being generally circular and bounding a first base of a generally right circular cylinder, the second hoop being generally circular and bounding a second base of the cylinder, the cylinder having a lateral surface which is fully open except for a minority of the lateral surface which is bounded by the connector, the cylinder having a diameter and the connector having a length, both determined so that the frame provides support for the napkin when the napkin is inserted in the frame, arranged unimpededly through and around the first hoop, through and around the second hoop, and through the cylinder lateral surface impeded only by the connector, so that the frame may rest stably on a horizontal surface with the cylinder lateral surface generally parallel to the horizontal surface, and alternatively so that the frame may rest stably on the horizontal surface with the cylinder lateral surface generally perpendicular to the horizontal surface;

folding the napkin;

inserting the napkin through the frame; and arranging the napkin through the frame.

4. The method of claim 3 wherein the napkin is arranged to rest stably on a horizontal surface with the cylinder lateral surface generally parallel to the horizontal surface.

5. The method of claim 3 wherein the napkin is arranged to rest stably on a horizontal surface with the cylinder lateral surface generally perpendicular to the horizontal surface.

6. The method of claim 3 wherein the napkin has color regions, the color regions having a first pattern when fully flat open, and the color regions being transmogrified to a new form when the napkin is arranged through the frame.

* * * * *